US005183382A

United States Patent [19]

Carroll

[11] Patent Number: 5,183,382

[45] Date of Patent: Feb. 2, 1993

[54] LOW NOISE ROTATING FAN AND SHROUD ASSEMBLY

[75] Inventor: Jim K. Carroll, Peoria, Ill.

[73] Assignee: Caterpillar Inc., Peoria, Ill.

[21] Appl. No.: 754,101

[22] Filed: Sep. 3, 1991

[51] Int. Cl.[5] ..... F04D 29/08

[52] U.S. Cl. ..... 415/173.6; 416/169 A; 416/189; 416/192; 123/41.49

[58] Field of Search ..... 416/169 A, 189, 192; 415/119, 170.1, 173.6, 174.5, 222, 223; 123/41.49

[56] References Cited

U.S. PATENT DOCUMENTS

| | | | |
|---|---|---|---|
| 2,030,993 | 2/1936 | Langenkamp et al. | 416/169 A |
| 3,680,977 | 8/1972 | Rabouyt et al. | 416/192 |
| 3,703,808 | 11/1972 | Stearns | 415/173.6 |
| 3,842,902 | 10/1974 | Foslusny | 416/192 |
| 4,181,172 | 1/1980 | Longhouse . | |
| 4,213,426 | 7/1980 | Longhouse . | |
| 4,329,946 | 5/1982 | Longhouse . | |
| 4,396,351 | 8/1983 | Hayashi et al. | 416/189 R |
| 4,398,508 | 8/1983 | Moon et al. . | |
| 4,505,641 | 3/1985 | Tsuchikawa et al. | 416/169 A |
| 4,515,511 | 5/1985 | Heerlein | 416/169 A |
| 4,566,852 | 1/1986 | Hauser . | |
| 4,685,513 | 8/1987 | Longhouse et al. . | |
| 4,768,472 | 9/1988 | Hayashi et al. | 415/173.6 |
| 4,836,148 | 6/1989 | Savage et al. . | |

*Primary Examiner*—Edward K. Look
*Assistant Examiner*—James A. Larson
*Attorney, Agent, or Firm*—Larry G. Cain

[57] ABSTRACT

The present rotating fan and shroud assembly reduces noise emitted therefrom and increases cooling system efficiency. The rotating fan and shroud assembly when combined with the labyrinth-type seal also improves serviceability and reduces maintenance time and cost. The positioning a the first end of an inlet bell-mouth portion of the shroud assembly between a pair of flexible members allows the assembly to be easily removed for servicing while preventing recirculation of the cooling air. A radially outward extension of the inlet bell-mouth portion, and the positioning of a second end of the inlet bell-mouth portion and its juncture with an intermediate portion in line with a leading edge of each of a plurality of blades provides a uniform contour for the flow of the cooling air as it enters into the plurality of blades. A radially outward extension of an outlet bell-mouth portion 76 extending axially beyond a trailing edge of the blades, and the positioning of a first end of the outlet bell-mouth portion and its juncture with the intermediate portion being substantially centered on the width of each of the plurality of blades further enhances the flow of the cooling air from each of the blades increase efficiency.

17 Claims, 3 Drawing Sheets

LOW NOISE ROTATING FAN AND SHROUD ASSEMBLY

TECHNICAL FIELD

This invention relates generally to cooling of internal combustion engines and more particularly to a rotating fan and shroud assembly for reducing the noise emitted from the fan and shroud assembly without reducing serviceability, efficiency or ability of the fan and shroud to cool the engine.

BACKGROUND ART

In general, it is common knowledge that the reduction of the clearance between the tip of a fan blade and the shroud in which the fan rotates will increase efficiency of the cooling system. Many attempts have been made to minimize the clearance between the tip of the fan blades and the shroud. The latest attempts to reduce the clearance has resulted in the shroud being attached to the tip of the fan blades and the shroud being rotated with the fan. An example of such an arrangement is shown in U.S. Pat. No. 4,566,852 issued to Kurt Hauser on Jan. 28, 1986. The patent discloses an axial fan arrangement in which an attempt has been made to reduce noise level without impairing fan efficiency. An air guide structure is provided which widens in the flow direction starting from adjacent the air inlet edges of the fan blades. The contour of the air guide structure conforms to the facing contour of the fan blades.

U.S. Pat. No. 4,213,426 issued to Richard E. Longhouse on Jul. 22, 1980 discloses an engine cooling fan shrouding comprised of a flexible shroud mounted on a stationary component and a rotating shroud carried by the blade tips of an engine mounted cooling fan.

The combinations disclosed above fail to provide the most efficient combination for reducing noise, preserving longevity and serviceability, and cooling of the engine. For example, movement of the engine relative to the seal will cause rubbing, deterioration of the seal and result in increased clearance, noise and recirculation of the cooling air which reduces the flow of cooling air through the blade. Other fan and shroud assemblies fail to insure a uniform transition of the cooling air going into and coming off of the tip of the blades, resulting in reduced efficiency and increased noise. Other fan and shroud assemblies fail to provide an appropriate outlet path for the cooling air which result in the air flow separation, blade stall, reduced efficiency and increased noise.

DISCLOSURE OF THE INVENTION

In one aspect of the invention, a rotating fan and shroud assembly is comprised of a center core, a plurality of radially extending blades and a shroud. The plurality of radially extending blades are attached to the core and include a body having a preestablished width, a leading edge, a trailing edge and a tip. The shroud is attached to the core. The shroud has a generally "C" shaped circular configuration, an inlet bell-mouth portion having a first end and a second end, an outlet bell-mouth portion having a first end and a second end, and an intermediate portion fixedly interposed between the second end of the inlet bell-mouth portion and the first end of the outlet bell-mouth portion. The juncture of the second end of the inlet bell-mouth portion and the intermediate portion is generally radially aligned with the leading edge of each of the plurality of blades. The first end of the inlet bell-mouth portion extends radially from the tips of the plurality of blades and extends axially beyond the leading edges of the plurality of blades. The second end of the outlet bell-mouth portion extends radially from the tips of the plurality of blades and extends axially beyond the trailing edges of the plurality of blades.

In another aspect of the invention, a rotating fan and shroud assembly has been adapted for use with an engine. The rotating fan and shroud assembly is comprised of a center core, a plurality of radially extending blades and a shroud. The center core is in driven relationship to the engine. The plurality of radially extending blades are attached to the core and each of the plurality of blades includes a body having a preestablished width, a leading edge, a trailing edge and a tip. The shroud is attached to the core. The shroud has a generally "C" shaped circular configuration, an inlet bell-mouth portion having a first end and a second end, an outlet bell-mouth portion having a first end and a second end, and an intermediate portion fixedly interposed between the second end of the inlet bell-mouth portion and the first end of the outlet bell-mouth portion. The juncture of the second end of the inlet bell-mouth portion and the intermediate portion is generally radially aligned with the leading edges of the plurality of blades. Furthermore, the first end of the inlet bell-mouth portion extends radially from the tips of the plurality of blades and extends axially beyond the leading edges of the plurality of blades. The second end of the outlet bell-mouth portion extends radially from the tips of the plurality of blades and extends axially beyond the trailing edges of the plurality of blades.

In another aspect of the invention, a rotating fan and shroud assembly has been adapted for use with an engine and an enclosure surrounding the rotating fan and shroud assembly. The rotating fan and shroud assembly is comprised of a center core, a plurality of radially extending blades, a shroud and a labyrinth-type seal. The center core is in driven relationship to the engine. The plurality of radially extending blades are attached to the core and each of the plurality of blades include a body having a preestablished width, a leading edge, a trailing edge and a tip. The shroud has a generally "C" shaped circular configuration. The shroud further has an inlet bell-mouth portion having a first end and a second end, an outlet bell-mouth portion having a first end and a second end, and an intermediate portion fixedly interposed between the second end of the inlet bell-mouth portion and the first end of the outlet bell-mouth portion. The juncture of the second end of the inlet bell-mouth portion and the intermediate portion is generally radially aligned with the leading edges of the plurality of blades and the first end extends radially from the tips of the plurality of blades and extends axially beyond the leading edges of the plurality of blades. The second end extends radially from the tips of the plurality of blades and extends axially beyond the trailing edges of the plurality of blades. The labyrinth-type seal includes a pair of flexible members attached to the enclosure. Each of the pair of flexible members are positioned axially on opposite sides of one of the first end of the inlet bell-mouth portion and the second end of the outlet bell-mouth portion a preestablished distance and each of the pair of flexible members have an inner peripheral surface positioned radially inward of the first end of the inlet bell-mouth portion a preestablished distance.

BEST MODE FOR CARRYING OUT THE INVENTION

Figure 1:
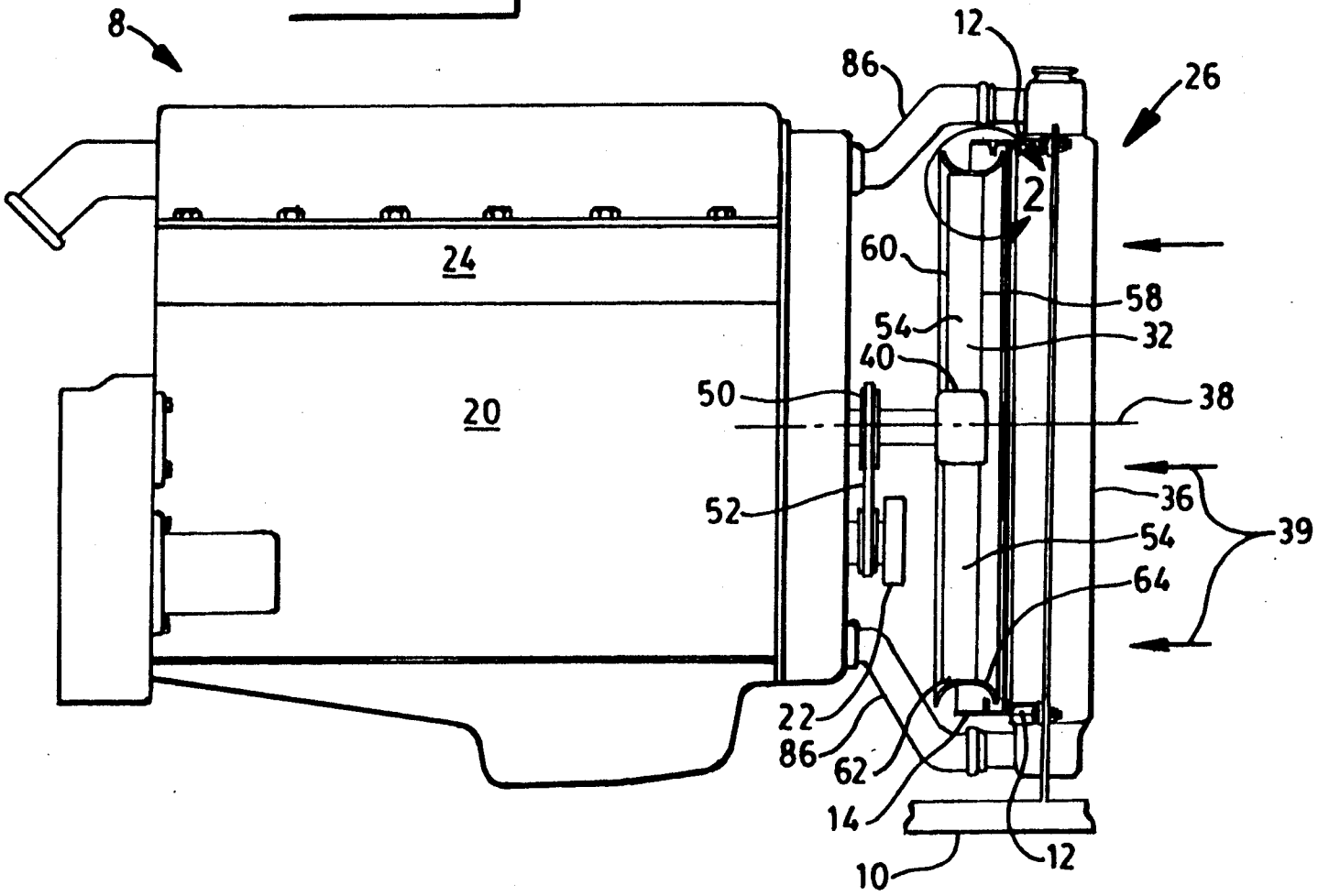
FIG. 1 is a partially sectioned side view of an engine and an enclosure having an embodiment of the present invention.

Referring to the drawings, a conventional multi-cylinder engine 8 is attached to a frame or structural enclosure 10, only partially shown. The enclosure 10 includes a plurality of mounting brackets 12. A ring 14 having an inner surface 16 and a generally cylindrical configuration is removable attached to the plurality of mounting brackets by a plurality of fasteners 18. The cylindrical ring 14 can be movable between alternate positions axial and radial by using conventional shims and slotted attaching mechanism, not shown. The engine 10 includes a block 20 having a crankshaft and pulley assembly 22 rotatably disposed partially therein, a cylinder head 24 attached to the block 20 and a liquid coolant system 26.

The liquid coolant system 26 includes a liquid coolant therein, not shown, a rotating fan and shroud assembly 32 positioned axially within the ring 14, a labyrinth-type seal 34 attached to the inner surface 16 of the ring 14 and a heat exchanger 36 attached to the enclosure 10 in a conventional manner, not shown. The rotating fan and shroud assembly 32 has an axis 38 about which it rotates. The fan and shroud assembly 32 directs a gaseous fluid, designated by the arrows 39, which in this application is atmospheric air, through the heat exchanger 36 to remove heat therefrom. In this application, the fan 32 is rotatably attached to an end of the engine 8 in a conventional manner. The fan 32 includes a center core 40 which is coaxial with the axis 38. The fan 32 further includes a pulley 50 in driving contact with a belt 52 for driving the assembly 32. The belt 52 is drivingly connected to the crankshaft and pulley assembly 22 and causes the assembly 32 to rotate at a constant speed relative to speed of the engine 8 crankshaft and pulley assembly 22. As an alternative, the fan assembly 32 could be rotated by a hydraulic or an electric motor. A plurality of blades 54 are attached to the core 40 and extends radially therefrom. Each of the blades 54 includes a body 56 having a preestablished width, a leading edge 58, a trailing edge 60, a tip 62 and a preestablished length. The preestablished length of the body 56 and the radius of the core 40 establish the fan diameter. The body 56 further has a generally curved configuration in transverse cross-section.

Figure 2:
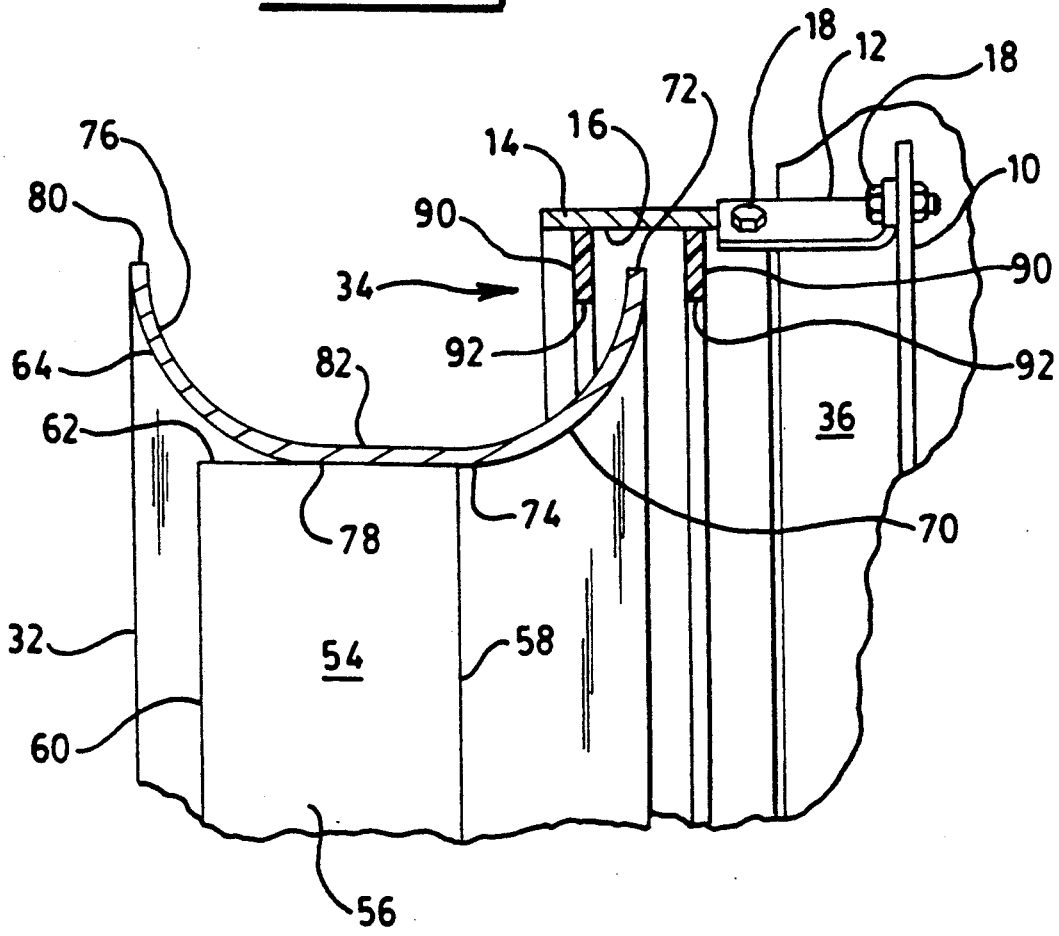
FIG. 2 is an enlarged broken out section view of the area circumscribed within line 2—2.

Attached to the tip 62 of each blade 54, such as by welding, is a generally "C" shaped circular shroud 64 which extends around the fan 32. The blade and the shroud assembly 32 could be formed by alternate processes such as by casting or molding. The material used to form the blade and shroud assembly 32 can be of either metallic or non-metallic material without changing the gist of the invention. As best shown in FIG. 2, the circular shroud 64 has an inlet bell-mouth portion 70 having a first end 72 extending radially outward and axially from a second end 74. The shroud 64 further has an outlet bell-mouth portion 76 having a first end 78 and a second end 80 extending radially outward and axially from the first end 78. And the shroud 64 further has an intermediate portion 82 fixedly interposed between the second end 74 of the inlet bell-mouth portion 70 with the first end 78 of outlet bell-mouth portion 76. In this application, the juncture of the first end 78 of the outlet bell-mouth portion 76 and the intermediate portion 82 is substantially centered on the width of each of the plurality of blades 54. The inlet bell-mouth portion 70 is positioned toward the incoming gaseous fluid 39 and the outlet bell-mouth portion 76 is positioned away from the incoming gaseous fluid 39. Each of the inlet and outlet bell-mouth portions 70,76 are formed by a preestablished radius which is between about 8 and 10 percent of the fan diameter. The intermediate portion 82 has a length which is about 0.5 times that of the blade 54 width. When the shroud 64 is attached to the tip 62 of each of the blades 54, the shroud 64 extends axially beyond the leading edge 58 and the junction of the second end 74 of the inlet bell-mouth portion 70 and the intermediate portion 82 is located generally radially aligned with the leading edge 58. Thus, from the junction of the first end 78 of the outlet bell-mouth portion 76 and the intermediate portion 82 the outlet bell-mouth portion 76 moves radially away from the tip 62 prior to extending beyond the trailing edge 60.

The heat exchanger 36 is of conventional design and, as stated above, is attached to the enclosure 10. The heat exchanger is positioned in front of the engine 8 and the assembly 32. A pair of hoses 86 interconnect the heat exchanger 36 with the engine 8 and provide a path for the liquid coolant to circulate therebetween. In this application, the rotating fan and shroud assembly 32 is of the sucker type and pulls the gaseous fluid 39 through the heat exchanger 36, through the assembly 32 and directs the gaseous fluid 39 past the engine 8.

As best shown in FIG. 2, the labyrinth-type seal 34 includes a pair of flexible ring members 90 attached to the inner surface 16 of the ring 14, such as by a cement, glue or bolting. The pair of flexible ring members 90 are individually axially positioned a preestablished distance on opposite sides of the first end 72 of the inlet bell-mouth portion 70. For example, in this application, each of the pair of flexible ring members 90 is spaced from a respective side of the first end 72 of the inlet bell-mouth portion 70 by about 10 mm. The ring members 90 are made of a flexible material such as rubber or fiber. Each of the flexible ring members 90 has an inner peripheral surface 92 disposed radially of the first end 72 of the inlet bell-mouth portion 70 by a preestablished distance. For example, in this application, the peripheral surface 92 of each of the pair of members 90 is spaced radially inwardly of the first end 72 of the inlet bell-mouth portion 70 a distance of about 10 mm. The ring 14 surrounding the rotating fan and shroud assembly 32 is radially spaced from the first end 72 of the inlet bell-mouth portion 70 and the second end 80 of the outlet bell-mouth portion 76 a preestablished radial distance. For example, in this application, the radial distance between the ring 14 and the first end 72 of the inlet bell-mouth portion 70 is about 10 mm. As is shown above, the preestablished radial distance between the ring 14 and the first end 72 of the inlet bell-mouth portion 70 is equal to the axial preestablished distance between the first end 72 of the inlet bell-mouth portion 70 and each of the pair of flexible members 90.

However, as an alternative the axial preestablished distance from the first end 72 of the inlet bell-mouth portion 70 and each of the pair of flexible members 90 is less than said radial preestablished distance from the first end 72 of the inlet bell-mouth portion 70 and the peripheral surface 92 of each of the pair of flexible members 90.

Figure 3:
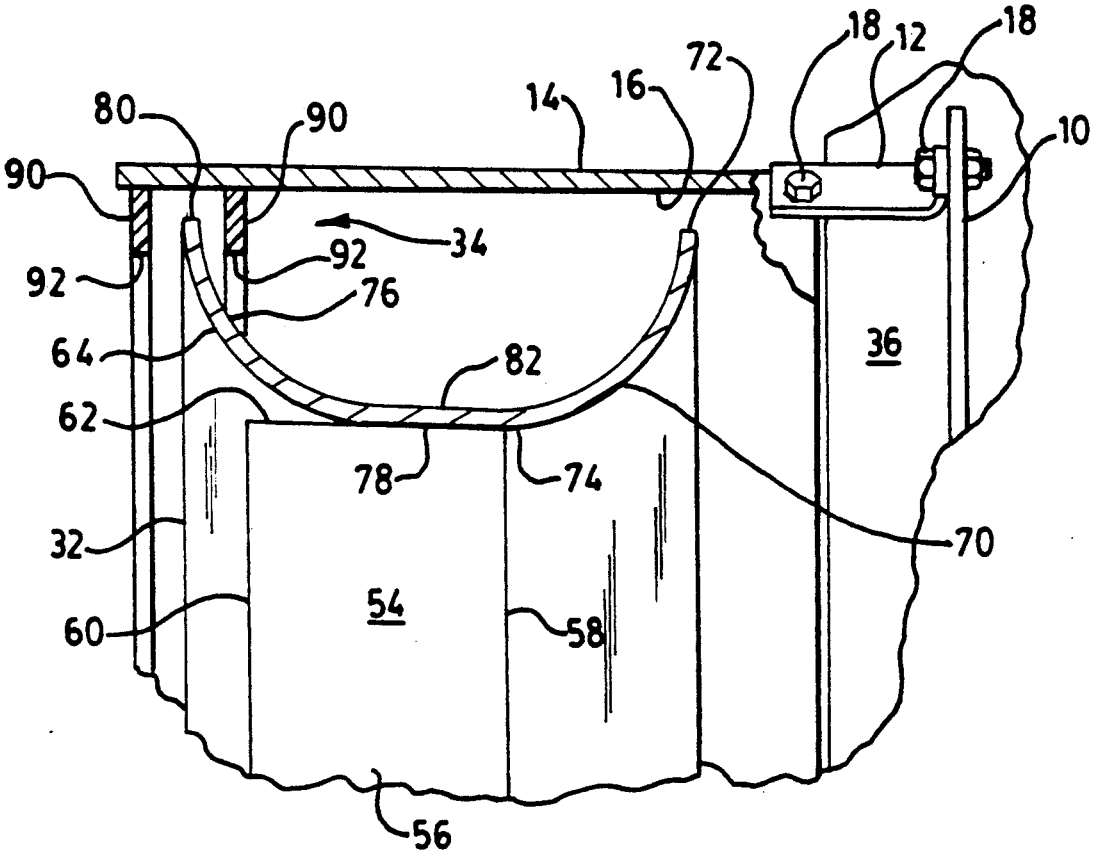
FIG. 3 is an enlarged alternate view of an embodiment of the present invention.

As an alternative and best shown in FIG. 3, the pair of flexible members 90 could be individually axially positioned a preestablished distance on opposite sides of the second end 80 of the outlet bell-mouth portion 76. For example, as is the application as applied to the inlet bell-mouth portion 70, each of the pair of flexible ring members 90 is spaced from a respective side of the second end 80 of the outlet bell-mouth portion 76 by about 10 mm. Each of the flexible ring members 90 has the inner peripheral surface 92 disposed radially of the second end 80 of the outlet bell-mouth portion 76 by a preestablished distance. For example, as is the application as applied to the inlet bell-mouth portion 70, the peripheral surface 92 of each of the pair of members 90 is spaced radially inwardly of the second end 80 of the outlet bell-mouth portion 76 a distance of about 10 mm. The ring 14 surrounding the rotating fan and shroud assembly 32 is radially spaced from the second end 80 of the outlet bell-mouth portion 76 and the first end 72 of the inlet bell-mouth portion 70 a preestablished radial distance. For example, in this application the inlet bell-mouth portion 70, the radial distance between the ring 14 and the second end 80 of the outlet bell-mouth portion 76 is about 10 mm. As is shown above, the preestablished radial distance between the ring 14 and the second end 80 of the outlet bell-mouth portion 76 is equal to the axial preestablished distance between the second end 80 of the outlet bell-mouth portion 76 and each of the pair of flexible members 90.

However, as an alternative the axial preestablished distance from the second end 80 of the outlet bell-mouth portion 76 and each of the pair of flexible members 90 is less than said radial preestablished distance from the second end 80 of the outlet bell-mouth portion 76 and the peripheral surface 92 of each of the pair of flexible members 90.

INDUSTRIAL APPLICABILITY

In application, the fan and shroud assembly 32 is attached to the engine 8 in a conventional manner and is driven by the crankshaft and pulley assembly 22 through the belt 52. The engine 8 is mounted to the platform and the ring 14 is attached to the enclosure 10. The pair of sealing members 90 are preassembled to the ring 14. Thus, the members 90 being made of a flexible material allows the peripheral surface 92 of one the sealing members 90 to be forced over the first end 72 of the inlet bell-mouth portion 70 and the ring 14 can be assembled in a sealing manner to the plurality of walls 12. If necessary, the position of the ring 14 can be varied by using shims or other convention procedures to insure the proper location of the ring 14 and pair of sealing members 90 relative to the first end 72 of the inlet bell-mouth portion 70. For example, slotted holes in the mounting of the ring 14 could be use to insure that the preestablished radial distance between the ring 14 and the first end 72 of the inlet bell-mouth portion 70 are as designed and functionally needed. Shims could be used to insure that the preestablished radial distances between the pair of sealing members 90 and the first end 72 of the inlet bell-mouth portion 70 are as designed and functionally needed. The preestablished distances are required to insure that the efficiency designed into the system is provided. For example, as the assembly 32 is rotated the atmospheric air 39 is drawn through the heat exchanger 36 by the assembly 32. Since the assembly 32 is sealed at the first end 72 of the inlet bell-mouth portion 70 by the labyrinth-type seal 34 the air 39 must pass through the plurality of blades 54. The rotation of the plurality of blades 54 directs the air 39 from the leading edge 58 both axially and radially along the body 56 to the tip 62 and the trailing edge 50. The positioning of the shroud 64 about the tip 62 of the plurality of blades 54 with the junction of first end 78 of the outlet bell-mouth portion 76 and the intermediate portion 82 being at the midpoint of the width of the body 56 allows the air 39 to radially escape from the assembly 32, thus, preventing the air 39 from separating and stalling on the blade. The radial contour of the outlet bell-mouth portion 76 which has the second end 80 radially outward of the tip 62 further allows the air 39 to radially escape from the assembly 32. The radial contour of the outlet bell-mouth portion 76 and the second end 80 of the outlet bell-mouth portion 76 further helps to prevent the air 39 from recirculating through the assembly 32. The labyrinth-type seal 34 insures that the recirculation of the air 39 does not hinder the efficiency of the system.

Thus, the present invention increases the efficiencies of cooling system by providing a rotating fan and shroud assembly 32 which reduces the recirculation of cooling air resulting in greater air flow, efficiency and reduced noise emitted therefrom. The assembly 32 and labyrinth-type seal 34 enhances the assembly and disassembly of the assembly 32 into the enclosure 10.

Other aspects, objects and advantages of this invention can be obtained from a study of the drawings, the disclosure and the appended claims.

I claim:

1. A cooling system adapted for use with an engine and an enclosure surrounding a rotating fan and shroud assembly; said cooling system comprising:

a rotating fan and shroud assembly having a center core being in driven relationship to the engine;

a plurality of radially extending blades being attached to the core, each of said plurality of blades including a body having a preestablished width, a leading edge, a trailing edge and a tip;

a shroud being positioned around the plurality of blades and being attached to the core, said shroud having a generally "C" shaped circular configuration, and inlet bell-mouth portion having a first end and a second end, an outlet bell-mouth portion having a first end and a second end, and an intermediate portion fixedly interposed between the second end of the inlet bell-mouth portion and the first end of the outlet bell-mouth portion, the juncture of the second end of the inlet bell-mouth portion and the intermediate portion is generally radially aligned with the leading edges of the plurality of blades, the juncture of the first end of the outlet bell-mouth portion and the intermediate portion is substantially centered on the width of each of the plurality of blades, the first end of the inlet bell-mouth portion extending radially outward from the tips of the plurality of blades and extending axially beyond the leading edges of the plurality of blades, and said second end of the outlet bell-mouth portion extending radially outward from the tips of the plurality of blades and extending axially beyond the trailing edges of the plurality of blades; and a labyrinth-type seal including a pair of flexible members being attached to the enclosure, said pare of flexible members bring positioned axially on opposite sides of one of the first end of the inlet bell-mouth portion and the second end of the outlet bell-mouth portion a preestablished distance and each of the pair of flexible members having an inner peripheral surface radially inward of one of the first end of the inlet bell-mouth portion and the second end of the outlet bell-mouth portion of preestablished distance.

2. The cooling systems of claim 1 wherein said pair of flexible members is positioned axially on opposite sided of the first end of the inlet bell-mouth portion.

3. The cooling system of claim 2 wherein said shroud is attached to the tip of each of the plurality of blades.

4. The cooling system of claim 2 wherein said preestablished axial distance from the first end of the inlet bell-mouth portion and each of the pair of flexible members is no greater than said preestablished radial distance from the first end of the inlet bell-mouth portion and the peripheral surface of each of the pair of flexible members.

5. The cooling system assembly of claim 2 wherein said preestablished axial distance from the first end of the inlet bell-mouth portion and each of the pair of flexible members is substantially equal to said preestablished radial distance from the first end of the inlet bell-mouth portion and the peripheral surface of each of the pair of flexible members.

6. The cooling system assembly of claim 2 wherein said enclosure includes a ring surrounding the rotating fan and shroud assembly, and said ring being radially spaced from the first end of the inlet bell-mouth portion a preestablished radial distance.

7. The cooling system assembly of claim 6 wherein said preestablished radial distance between the ring and the first end of the inlet bell-mouth portion is substantially equal to the preestablished axial distance between the first end of the inlet bell-mouth portion and each of the pair of flexible members.

8. The cooling system assembly of claim 7 wherein said preestablished axial distance from the first end of the inlet bell-mouth portion and each of the pair of flexible members is no greater than said preestablished radial distance from the first end of the inlet bell-mouth portion and the peripheral surface of each of the pair of flexible members.

9. The cooling system assembly of claim 7 wherein said preestablished axial distance from the first end of the inlet bell-mouth portion and each of the pair of flexible members is substantially equal to said preestablished radial distance from the first end of the inlet bell-mouth portion and the peripheral surface of each of the pair of flexible members.

10. The cooling system assembly of claim 1 wherein said pair of flexible members is positioned axially on opposite sides of the second end of the outlet bell-mouth portion.

11. The cooling system assembly of claim 10 wherein said shroud is attached to the tip of each of the plurality of blades.

12. The cooling system assembly of claim 10 wherein said enclosure includes a ring surrounding the rotating fan and shroud assembly, and said ring being radially spaced from the first end of the inlet bell-mouth portion a preestablished radial distance.

13. The cooling system assembly of claim 12 wherein said preestablished radial distance between the ring and the first end of the inlet bell-mouth portion is substantially equal to the preestablished axial distance between the first end of the outlet bell-mouth portion and each of the pair of flexible members.

14. A rotating fan and shroud assembly comprising:

a center core;

a plurality of radially extending blades being attached to the core, each of said plurality of blades including a body having a preestablished width, a leading edge, a trailing edge and a tip; and a shroud being positioned around the plurality of blades and being attached to the core, said shroud having a generally "C" shaped circular configuration, an inlet bell-mouth portion having a first end and a second end, an outlet bell-mouth portion having a first end and a second end, and an intermediate portion fixedly interposed between the second end of the inlet bell-mouth portion and the first end of the outlet bell-mouth portion, the juncture of the second end of the inlet bell-mouth portion and the intermediate portion is generally radially aligned with the leading edges of the plurality of blades, the juncture of the first end of the outlet bell-mouth portion and the intermediate portion being substantially centered on the width of each of the plurality of blades, the first end of the inlet bell-mouth portion extending radially outward from the tips of the pluraltiy of blades and extending axially beyond the leading edges of the pluraltiy of blades, and said second end of the outlet bell-mouth portion extending radially outward from the tips of the plurality of blades and extending axially beyond the trailing edge of the plurality of blades.

15. The rotating fan and shroud assembly of claim 14 wherein said shroud is attached to the tip of each of the plurality of blades.

16. A rotating fan and shroud assembly adapted for used with an engine; said rotating fan and shroud assembly comprising:

a center core being in driven relationship to the engine;

a plurality of radially extending blades being attached to the core, each of said plurality of blades including a body having a preestablished width, a leading edge, a trailing edge and a tip; and a shroud being positioned around the plurality of blades and being attached the core, said shroud having a generally "C" shaped circular configuration, and inlet bell-mouth portion having a first end and a second end, an outlet bell-mouth portion having a first end and a second end, and an intermediate portion fixedly interposed between the second end of the inlet bell-mouth portion and the first end of the outlet bell-mouth portion, the juncture of the second end of the inlet bell-mouth portion and the intermediate portion is generally radially aligned with the leading edges of the plurality of blades, the juncture of the first end of the outlet bell-mouth portion and the intermediate portion is substantially centered on the width of each of the plurality of blades, the first end of the inlet bell-mouth portion extending radially outward from the tips of the plurality of blades and extending axially beyond the leading edges of the plurality of blades, and said second end of the outlet bell-mouth portion extending radially outward from the tips of the plurality of blades and extending axially beyond the trailing edges of the plurality of blades.

17. The rotating fan and shroud assembly of claim 16 wherein said shroud is attached to the tip of each of the plurality of blades.

* * * * *

UNITED STATES PATENT AND TRADEMARK OFFICE

CERTIFICATE OF CORRECTION

PATENT NO. : 5,183,382

DATED : February 2, 1993

INVENTOR(S) : Jim K. Carroll

It is certified that error appears in the above-identified patent and that said Letters Patent is hereby corrected as shown below:

Claim 1, column 7, line 3, "bring" should be --being--.

Claim 1, column 7, line 9, "of" should be --a--.

Claim 2, column 7, line 12, "sided" should be --sides--.

Claim 14, column 8, line 29, "edge" should be --edges--.

Signed and Sealed this

Second Day of November, 1993

*Attest:*

Bruce Lehman

BRUCE LEHMAN

*Attesting Officer*

*Commissioner of Patents and Trademarks*